US008044890B2

(12) United States Patent
Lee

(10) Patent No.: US 8,044,890 B2
(45) Date of Patent: Oct. 25, 2011

(54) PLASMA DISPLAY DEVICE AND DRIVING METHOD THEREOF

(75) Inventor: Joo-Yul Lee, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 974 days.

(21) Appl. No.: 11/940,254

(22) Filed: Nov. 14, 2007

(65) Prior Publication Data

US 2008/0158101 A1 Jul. 3, 2008

(30) Foreign Application Priority Data

Dec. 27, 2006 (KR) ..... 10-2006-0135065

(51) Int. Cl.
*G09G 3/28* (2006.01)

(52) U.S. Cl. ..... 345/68; 345/60; 345/67; 345/204; 345/690; 345/691; 315/167; 315/169.1; 315/169.4

(58) Field of Classification Search ..... 345/55, 345/60, 67, 68, 204, 690, 691; 315/167, 315/169.1, 169.4
See application file for complete search history.

(56) References Cited

U.S. PATENT DOCUMENTS

| | | | | |
|---|---|---|---|---|
| 7,612,741 | B2 * | 11/2009 | Kim | 345/67 |
| 7,642,993 | B2 * | 1/2010 | Ito | 345/63 |
| 2005/0083252 | A1 | 4/2005 | Roh et al. | |
| 2005/0104809 | A1 | 5/2005 | Chung et al. | |
| 2005/0168407 | A1 | 8/2005 | Lee et al. | |
| 2006/0038806 | A1 * | 2/2006 | Jeong | 345/204 |
| 2006/0077133 | A1 * | 4/2006 | Yang et al. | 345/68 |
| 2007/0103393 | A1 * | 5/2007 | Han | 345/60 |

FOREIGN PATENT DOCUMENTS

| | | |
|---|---|---|
| EP | 1 020 838 A1 | 7/2000 |
| EP | 1 416 465 A2 | 5/2004 |
| JP | 7-319424 | 12/1995 |
| JP | 2000-242227 | 9/2000 |
| JP | 2000-267627 | 9/2000 |
| JP | 2004-151348 | 5/2004 |

(Continued)

OTHER PUBLICATIONS

European Search report dated Dec. 15, 2008 for corresponding application No. EP 07 12 2224, indicating relevance of listed references in this IDS.

(Continued)

*Primary Examiner* — My-Chau T Tran
(74) *Attorney, Agent, or Firm* — Christie, Parker & Hale, LLP

(57) ABSTRACT

A method for driving a plasma display device including first electrodes and second electrodes. In one embodiment, the plurality of first electrodes are divided into a plurality of groups including first and second groups. During a first period of a sustain period, a second voltage is applied to the first and second groups of the first electrodes while a first voltage is applied to the second electrodes, the second voltage being higher than the first voltage. During a second period of the sustain period, while the second voltage is applied to the second electrodes, the first voltage is applied to the first group of the first electrodes, and the first voltage is applied to the second group of the first electrodes a period of time after when the first voltage is initially applied to the first group of the first electrodes.

17 Claims, 8 Drawing Sheets

FOREIGN PATENT DOCUMENTS

| | | |
|---|---|---|
| JP | 2005-070784 | 3/2005 |
| JP | 2006-330603 | 12/2006 |
| KR | 10-2004-0077190 | 9/2004 |
| KR | 10-0509609 | 8/2005 |
| KR | 10-0570701 | 4/2006 |

OTHER PUBLICATIONS

Patent abstracts of Japan for publication No. 07-319424 dated Dec. 8, 1995 in the name of Koji Ito, et al.

Korean patent abstracts for publication No. 1020040077190 A dated Sep. 4, 2004 in the name of Yeong Dae Kim.

Korean patent abstracts for publication No. 100509609 B1 dated Aug. 12, 2005 in the name of Joo Yul Lee.

Korean patent abstracts for publication No. 100570701 B1 dated Apr. 6, 2006 in the name of Hye Kwang Park.

* cited by examiner

PLASMA DISPLAY DEVICE AND DRIVING METHOD THEREOF

CROSS-REFERENCE TO RELATED APPLICATION

This application claims priority to and the benefit of Korean Patent Application No. 10-2006-0135065 filed in the Korean Intellectual Property Office on Dec. 27, 2006, the entire content of which is incorporated herein by reference.

BACKGROUND OF THE INVENTION

1. Field of the Invention

The present invention relates to a plasma display device and a driving method thereof.

2. Description of the Related Art

A plasma display device is a display device employing a plasma display panel (PDP) that is configured to display characters and/or images using plasma generated by gas discharge. The PDP includes hundreds of thousands to millions of discharge cells arranged in a matrix format depending on its size.

The plasma display device is driven during frames, each of which is divided into a plurality of subfields having brightness weight values, and each subfield includes a reset period, an address period, and a sustain period.

The reset period is a period for initializing a state of each cell so as to smoothly perform an address operation in the cells, and the address period is a period wherein cells are selected to emit light among a plurality of cells through address discharges. In addition, the sustain period is for causing discharges for displaying an image at addressed (or selected) cells.

During the sustain period of the plasma display device, sustain discharges are generated in selected cells by applying sustain pulses alternately having a high level voltage and a low level voltage to scan electrodes and sustain electrodes. Here, phases of the sustain pulses applied to the scan and sustain electrodes are opposite to each other. In addition, a width of a first sustain pulse applied to the scan and sustain electrodes is increased to be longer than widths of subsequent sustain pulses to stably generate the sustain discharge at the cells selected to be turned on.

However, when the width of the first sustain pulse applied during the sustain period is increased as described above, a considerable amount of wall charges are formed between the scan and sustain electrodes. As such, when a second sustain pulse (i.e., a pulse for applying the low level voltage to the scan electrodes and the high level voltage to the sustain electrodes) is applied subsequent to the first sustain pulse, a strong discharge is generated between the scan and sustain electrodes, and a current that is stronger than the currents generated when the subsequent sustain pulses are applied, is generated. Since the stronger current may flow to one or more elements of a driving circuit for generating a sustain pulse waveform, the elements may be deteriorated.

The above information disclosed in this Background section is only for enhancement of understanding of the background of the present invention, and therefore it may contain information that does not form the prior art that is already known in this country to a person of ordinary skill in the art.

SUMMARY OF THE INVENTION

Aspects of the present invention are directed to providing a plasma display device for preventing one or more elements of a driving circuit that generates a sustain pulse waveform during a sustain period from exposure to a considerable amount of generated discharge current, and for stably driving the driving circuit, and a driving method thereof.

In an exemplary embodiment of the present invention, a method for driving a plasma display device during a reset period, an address period and a sustain period is provided. The plasma display device includes a plurality of first electrodes including a first group of the first electrodes and a second group of the first electrodes, and a plurality of second electrodes. The method includes: during a first period of the sustain period, applying a second voltage to the first group of the first electrodes and the second group of the first electrodes while a first voltage is applied to the second electrodes, the second voltage being higher than the first voltage; and during a second period of the sustain period, while the second voltage is applied to the second electrodes, applying the first voltage to the first group of the first electrodes, and applying the first voltage to the second group of the first electrodes a period of time after when the first voltage is initially applied to the first group of the first electrodes in the second period. The first period is longer than the second period, and a third voltage between the first voltage and the second voltage is applied to the second group of the first electrodes during the period of time.

According to an another exemplary embodiment of the present invention, a plasma display device is adapted to be driven during a reset period, an address period and a sustain period. The plasma display device includes a plasma display panel. The plasma display panel includes: a plurality of first electrodes including a first group of the first electrodes and a second group of the first electrodes; and a plurality of second electrodes, wherein a plurality of panel capacitors are formed by the first and second electrodes. The plasma display device further includes: a scan driver including a plurality of selection circuits, a first selection circuit of the selection circuits including first and second switches and a second selection circuit of the selection circuits including third and fourth switches, the scan driver being for sequentially applying a scan voltage to the first group of the first electrodes through the first switch and to a second group of the first electrodes through the third switch, and applying a non-scan voltage to the first group of the first electrodes through the second switch and to the second group of the first electrodes through the fourth switch; and a sustain driver for applying a sustain pulse alternately having a first voltage and a second voltage lower than the first voltage to the first group of the first electrodes through the first selection circuit, and applying the sustain pulse to the second group of the first electrodes through the second selection circuit. During the sustain period, the sustain driver is configured to: during a first period of the sustain period, apply the first voltage to the first group of the first electrodes and the second group of the first electrodes through the first and third switches, respectively; during a second period of the sustain period, apply the second voltage to the second group of the first electrodes through the third switch, the second period being shorter than the first period; during a period of time starting when the second voltage is initially applied to the second group of the first electrodes in the second period, apply a third voltage between the first and second voltages to the first group of the first electrodes through the second switch; and after the period of time in the second period, apply the second voltage to the first group of the first electrodes through the first switch.

DETAILED DESCRIPTION

Figure 1:
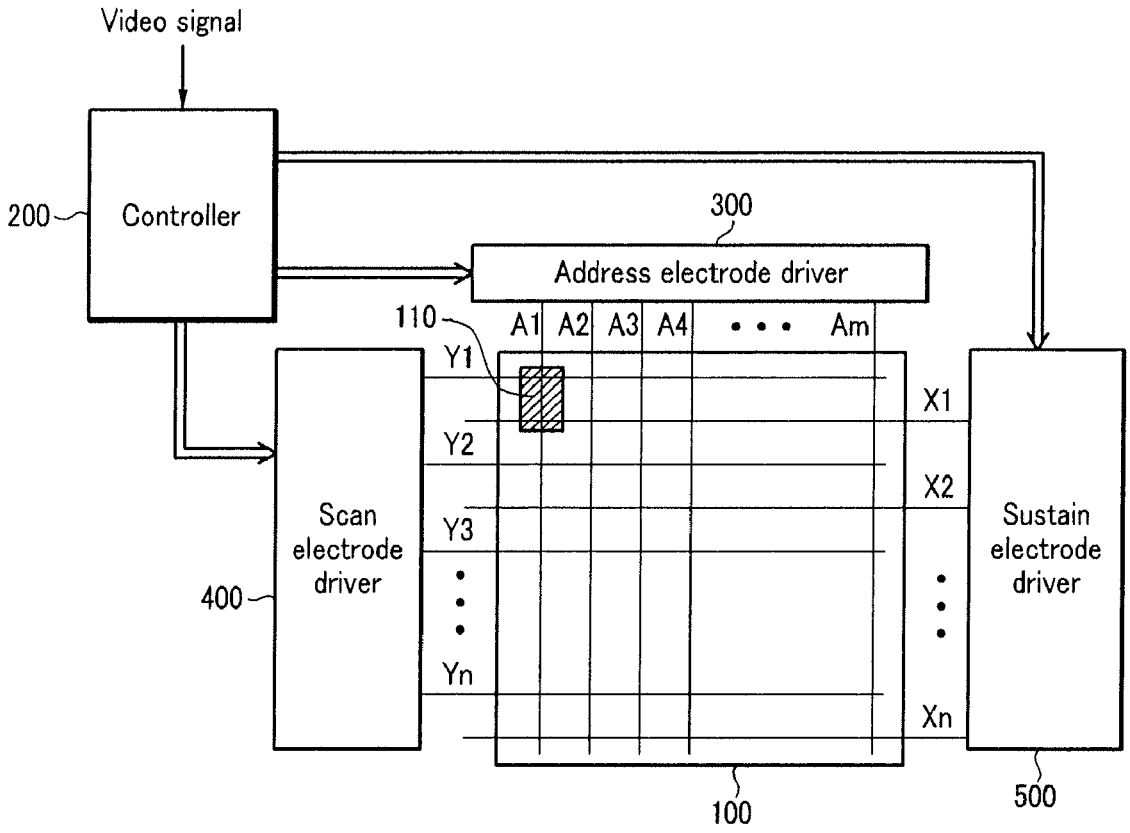
FIG. 1 shows a schematic diagram of a plasma display device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification. Throughout this specification and the claims which follow, unless explicitly described to the contrary, the word "comprise" or variations such as "comprises" or "comprising" will be understood to imply the inclusion of stated elements but not the exclusion of any other elements.

In addition, in practice, wall charges are charges formed and accumulated on a wall (e.g., a dielectric layer) close to an electrode of a discharge cell. However, in the disclosure, wall charges will be described as being "formed" or "accumulated" on the electrodes, although the wall charges do not actually touch the electrodes. Further, a wall voltage is a potential difference formed on the wall of the discharge cell by the wall charges.

Further, throughout this specification and the claims that follow, when it is described that a first element is "coupled" to a second element, the first element may be "directly coupled" to the second element or "electrically coupled" to the second element through one or more other elements.

FIG. 1 shows a schematic diagram of a plasma display device according to an exemplary embodiment of the present invention.

As shown in FIG. 1, the plasma display device includes a plasma display panel (PDP) 100, a controller 200, an address electrode driver 300, a scan electrode driver 400, and a sustain electrode driver 500.

The PDP 100 includes a plurality of address electrodes A1 to Am extending in a column direction, and a plurality of sustain and scan electrodes X1 to Xn and Y1 to Yn in pairs extending in a row direction. In general, the sustain electrodes X1 to Xn are formed corresponding to the scan electrodes Y1 to Yn, respectively. The sustain electrodes and scan electrodes perform a display operation for displaying an image in the sustain period. The scan electrodes Y1 to Yn and the sustain electrodes X1 to Xn are disposed to cross the address electrodes A1 to Am. Discharge spaces at crossing regions of the address electrodes A1 to Am and the sustain and scan electrodes X1 to Xn and Y1 to Yn form cells (or discharge cells) 110. It is to be noted that the above-described construction of the PDP is presented only as an example, and panels having different structures, to which a driving waveform (to be described later) can be applied, may be applied to the present invention.

The controller 200 receives an external video signal, and outputs an address electrode driving control signal, a sustain electrode driving control signal, and a scan electrode driving control signal. The controller 200 drives the plasma display device during frames, each of which is divided into a plurality of subfields. Each subfield includes a reset period, an address period and a sustain period. In addition, the controller 200 according to an exemplary embodiment of the present invention divides the plurality of scan electrodes into a plurality of groups.

The address electrode driver 300 receives the address electrode driving control signal from the controller 200, and applies a display data signal, for selecting discharge cells on which an image will be displayed, to each electrode.

The scan electrode driver 400 receives the scan electrode driving control signal from the controller 200, and applies a driving voltage to the scan electrodes.

The sustain electrode driver 500 receives the sustain electrode driving control signal from the controller 200, and applies a driving voltage to the sustain electrodes.

Figure 2:
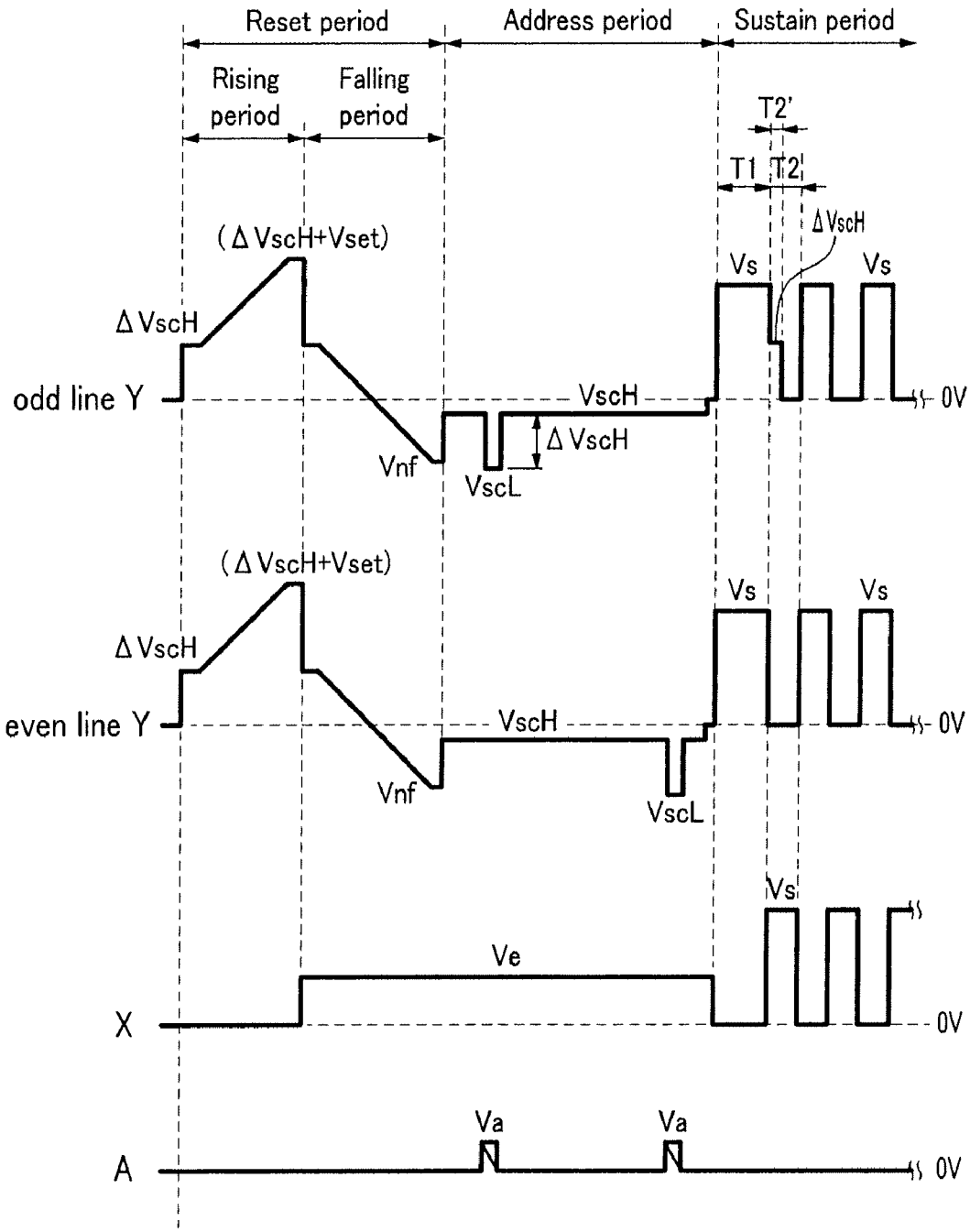
FIG. 2 shows a diagram representing driving waveforms of a plasma display device according to an exemplary embodiment of the present invention.

FIG. 2 shows a diagram representing driving waveforms of the plasma display device according to an exemplary embodiment of the present invention.

In FIG. 2, a plurality of scan electrodes Y1 to Yn are divided into a plurality of groups. By way of example, the plurality of scan electrodes are divided into odd and even groups, the odd group being denoted by an "odd line Y", and the even group being denoted by an "even line Y". In addition, for better understanding and ease of description, signals corresponding to respective individual scan electrodes (i.e., one odd line Y and one even line Y) among the scan electrodes of the odd and even groups are illustrated in FIG. 2. Further, signals corresponding to one sustain electrode X and one address electrode A corresponding to the scan electrodes (i.e., one odd line Y and one even line Y) of the odd and even groups are illustrated. Here, the scan electrodes (i.e., one odd line Y and one even line Y) of the odd and even groups will collectively be referred to as the "scan electrode Y".

As shown in FIG. 2, in an exemplary embodiment of the present invention, the plurality of scan electrodes Y1 to Yn are divided into the odd group and the even group such that different driving waveforms can be applied to the two groups.

In further detail, while the sustain electrode X and the address electrode A are biased to a reference voltage (e.g., 0V in FIG. 2) during a rising period of the reset period, a voltage at the scan electrode Y is gradually increased from a ΔVscH voltage to a ΔVscH+Vset voltage. Thereby, while the voltage at the scan electrode Y is gradually increased during the rising period, a weak discharge is generated between the scan electrode Y and the sustain electrode X and between the scan electrode Y and the address electrode A, negative (−) wall charges are formed on the scan electrode Y, and positive (+) wall charges are formed on the sustain electrode X and the address electrode A.

In addition, since wall voltages formed between the respective electrodes in the plurality of cells are different from each other, the ΔVscH+Vset voltage is set high enough to generate discharges in the cells regardless of the wall charges formed in the cells. Here, the ΔVscH+Vset voltage is set to be greater than a voltage that is double a discharge firing voltage between the sustain electrode X and the scan electrode Y.

In addition, in FIG. 2, it is illustrated that a voltage (e.g., a predetermined voltage) applied to the scan electrode at a rising period starting point of the reset period is the ΔVscH voltage corresponding to a difference between a non-scan voltage VscH and a scan voltage VscL. The non-scan voltage VscH is higher than the scan voltage by the ΔVscH voltage.

That is, the voltage (e.g., the predetermined voltage) applied at the rising period starting point corresponds to a voltage level that is higher than the reference voltage by the ΔVscH voltage. In one embodiment, the predetermined voltage may be a high level voltage Vs of the sustain pulses applied to the scan electrode Y and the sustain electrode X during the sustain period. Here, a Vset voltage is set such that a sum (Vs+Vset) of the Vset voltage and the Vs voltage is higher than the discharge firing voltage.

Subsequently, while voltages of the sustain electrode X and the address electrode A are respectively maintained to be a bias voltage (e.g., a Ve voltage in FIG. 2) and the reference voltage, the voltage at the scan electrode Y is gradually decreased from the ΔVscH voltage to a Vnf voltage. While the voltage at the scan electrode Y is gradually decreased, a weak discharge is generated between the scan electrode Y and the sustain electrode X and between the scan electrode Y and the address electrode A, and the negative (−) wall charges formed on the scan electrode Y and the positive (+) wall charges formed on the sustain electrode X and the address electrode A are eliminated (or erased) such that an address operation can be performed.

Subsequently, to select cells to be turned on during the address period, while the voltage at the sustain electrode X is biased at the Ve voltage, the scan voltage (e.g., the VscL voltage in FIG. 2) is applied to the scan electrode Y. Here, in FIG. 2, it is illustrated that the scan voltage VscL is applied to the odd group of the scan electrodes (i.e., the odd line Y), and subsequently the scan voltage VscL is applied to the even group of the scan electrodes (i.e., the even line Y). In another embodiment, the scan voltage VscL may be sequentially applied to the scan electrodes Y according to an order of the scan electrodes Y1 to Yn regardless of the odd and even groups. That is, the scan voltage VscL is applied to a first scan electrode Y1, the scan voltage VscL is then applied to a second scan electrode Y2, the scan voltage VscL is then applied to a third scan electrode Y3, and so on.

Subsequently, an address voltage (e.g., the Va voltage in FIG. 2) is applied to the address electrode A corresponding to the cells formed by the scan electrode receiving the scan voltage VscL among the scan electrodes Y. Thereby, an address discharge is generated between the address electrode A receiving the address voltage Va and the scan electrode Y receiving the scan voltage VscL, and the cells to be turned on are selected. Here, the non-scan voltage VscH that is higher than the scan voltage VscL by ΔVscH is applied to the scan electrodes to which the scan voltage is not applied, and the reference voltage is applied to the address electrodes A of the cells that are not selected.

Then, during the sustain period, sustain pulses are applied to the scan electrode Y and the sustain electrode X. In further detail, sustain pulses having opposite phase, each of which alternately has the high level voltage (e.g., the Vs voltage in FIG. 2) and the low level voltage (e.g., 0V in FIG. 2), are applied to the scan electrode Y and the sustain electrode X. That is, since the low level voltage 0V is applied to the sustain electrode X while the high level voltage Vs is applied to the scan electrode Y, a voltage difference between the two electrodes is the Vs voltage. Thereby, the sustain discharge is generated between the scan electrode Y and the sustain electrode X by the wall voltage formed in the cells selected to be turned on during the address period and the voltage difference of the applied sustain pulses. Here, the Vs voltage is set to be lower than the discharge firing voltage between the scan electrode Y and the sustain electrode X. The sustain pulses are then applied to the scan electrode Y and the sustain electrode X a number of times corresponding to a brightness weight value of the corresponding subfield.

In an exemplary embodiment of the present invention, the width of the first sustain pulse among the sustain pulses applied to the scan electrode Y and the sustain electrode X during the sustain period is longer than the widths of the subsequent sustain pulses. That is, as shown in FIG. 2, the firstly applied sustain pulse during the sustain period has a pulse width of T1, and the subsequent sustain pulses each have the pulse width of T2 that is shorter than T1. As will be described in more detail below, the sustain discharge is stably generated by increasing the width of the first sustain pulse to be longer than those of the subsequent sustain pulses, and sufficient wall charges are formed on the scan and sustain electrodes when a first sustain discharge is generated. That is, when the high level voltage Vs is applied to the scan electrode Y and the low level voltage 0V is applied to the sustain electrode X, the sustain discharge is generated, and the negative (−) wall charges and the positive (+) wall charges are respectively formed on the scan electrode Y and the sustain electrode X. Since a time for respectively applying the high level voltage Vs and the low level voltage 0V to the scan electrode Y and the sustain electrode X is increased, more negative (−) wall charges are attracted to the scan electrode Y and more positive (+) wall charges are attracted to the sustain electrode X. Accordingly, since sufficient wall charges are formed on the scan electrode Y and the sustain electrode X, the stable sustain discharge may be generated between the two electrodes when the sustain pulses are applied.

However, when the width of the first sustain pulse is longer than those of the subsequent sustain pulses starting from the second sustain pulse, a strong discharge is generated by the wall charges that are sufficiently formed by the first sustain pulse, and a considerable amount of current (discharge current) may flow when the second sustain pulse is applied. That is, the considerable amount of current flows to one or more elements of the driving circuit generating the above driving waveform, and therefore the elements may be deteriorated. Accordingly, in an exemplary embodiment of the present invention, the plurality of scan electrodes Y1 to Yn to which the sustain pulses are applied are divided into a plurality of groups, the second sustain pulse is differently applied to the respective groups, and times for generating the sustain discharge in the respective groups are different (e.g., offset) to disperse the amount of discharge currents.

That is, as shown in FIG. 2, when the second sustain pulse is applied, the low level voltage 0V is applied to the even group of the scan electrodes (even line Y) while the high level voltage Vs is applied to the sustain electrode X during a period of T2, the ΔVscH voltage is applied to the odd group of the scan electrodes (odd line Y) during a period of T2', and the low level voltage 0V is applied to the odd line Y during a period of (T2-T2'). Accordingly, the sustain discharge is generated between the sustain electrode X receiving the high level voltage of the sustain pulse and the even group of the scan electrodes (even line Y) receiving the low level voltage 0V, and the sustain discharge is generated between the odd group of the scan electrodes (odd line Y) receiving the low level after the period of T2' and the sustain electrode receiving the high level voltage Vs. That is, the sustain discharges are generated at the odd and even groups of the scan electrodes (odd line Y and even line Y) and the sustain electrode X at different times, and therefore one or more elements of the driving circuit may be prevented from being exposed to a considerable amount of discharge current.

In addition, it has been described that the plurality of scan electrodes Y1 to Yn are divided into two groups (i.e., the odd and even groups) in FIG. 2 in the current exemplary embodiment of the present invention, but the invention is not limited thereto, and the scan electrodes may be divided into two or more groups (e.g., the scan electrodes may be divided into two or more groups according to an order of the scan electrodes) to control the timing of the second sustain discharges to be different from each other.

A driving circuit for driving the plasma display device by applying the driving waveform shown in FIG. 2 will be described with reference to FIG. 3.

Figure 3:
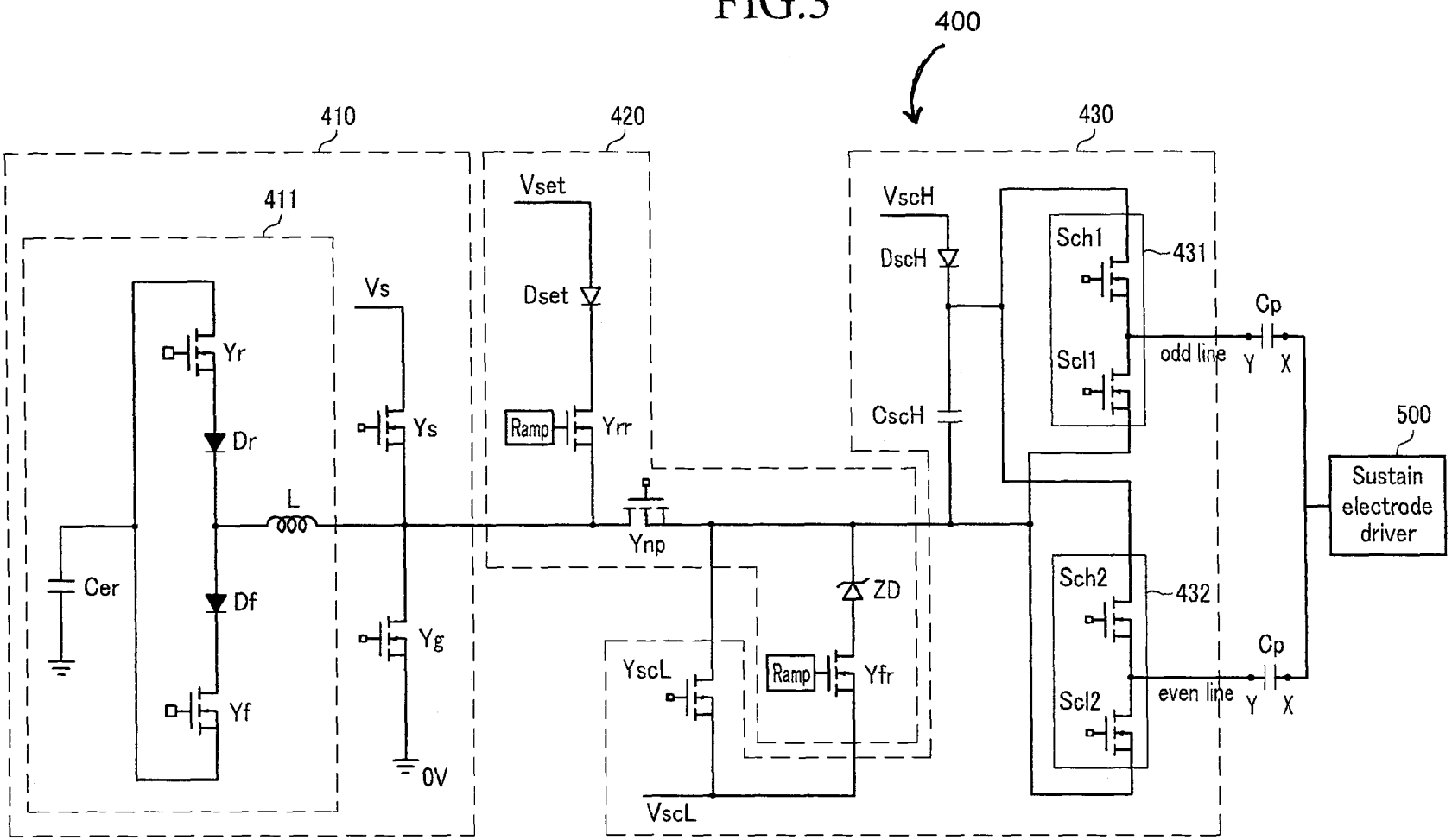
FIG. 3 shows a diagram representing a driving circuit of a scan electrode driver according to an exemplary embodiment of the present invention.

FIG. 3 shows a circuit diagram of the driving circuit of the scan electrode driver according to an exemplary embodiment of the present invention.

Switches in the circuit diagram of FIG. 3 are illustrated as n-channel field effect transistors (FETs) having body diodes, and other switches having a same or similar function may be used. In addition, capacitances formed by the scan electrode Y, the sustain electrode X, and the address electrode A are illustrated as panel capacitors Cp.

As shown in FIG. 3, the scan electrode driver 400 includes a sustain driver 410, a reset driver 420, and a scan driver 430.

The sustain driver 410 includes a power recovery unit 411 and transistors Ys and Yg. The power recovery unit 411 includes transistors Yr and Yf, an inductor L, diodes Dr and Df, and a power recovery capacitor Cer.

In further detail, the transistor Ys is coupled between a power source terminal Vs for supplying the Vs voltage and the scan electrodes of the panel capacitors Cp, and the transistor Yg is coupled between a ground terminal 0V for supplying the 0V voltage and the scan electrodes of the panel capacitors Cp. Here, the transistor Ys forms a path for applying the Vs voltage to the scan electrode Y, and the transistor Yg forms a path for applying the 0V voltage to the scan electrode Y.

A first terminal of the power recovery capacitor Cer is coupled to a node between the transistors Yr and Yf, and the power recovery capacitor Cer is charged with a voltage Vs/2, which is midway between the Vs voltage and the 0V voltage. Here, the first terminal of the power recovery capacitor Cer is coupled to a drain of the transistor Yr and a source of the transistor Yf.

A first terminal of the inductor L is coupled to a source of the transistor Yr and a drain of the transistor Yf, and a second terminal thereof is coupled to the scan electrode Y. The diode Dr is coupled between the source of the transistor Yr and the inductor L, and the diode Df is coupled between the drain of the transistor Yf and the inductor L. The diode Dr is used to form a voltage increasing path for increasing a voltage of the panel capacitors Cp via the body diode of the transistor Yr, and the diode Df is used to form a voltage decreasing path for decreasing a voltage of the scan electrode Y via the body diode of the transistor Yf. When the transistors Yr and Yf do not have the body diode, the diodes Dr and Df may be eliminated.

The power recovery unit 411 uses a resonance between the panel capacitor Cp and the inductor L to increase the voltage at the scan electrode Y from the 0V voltage to a voltage near the Vs voltage or to decrease the voltage from the Vs voltage to a voltage near the 0V voltage.

The connection order of the inductor L, the diode Df, and the transistor Yf in the power recovery unit 411 may be changed, and the connection order of the inductor L, the diode Dr, and the transistor Yr may also be changed. For example, the inductor L may be coupled between a node between the transistors Yr and Yf and the power recovery capacitor Cer. In addition, although the inductor L is shown as being coupled to the node between the transistors Yr and Yf in FIG. 3, the inductor may be coupled to a voltage increasing path formed by the transistor Yr and a voltage decreasing path formed by the transistor Yf.

The reset driver 420 includes transistors Yrr, Yfr, and Ynp, a Zener diode ZD, and a diode Dset, and it gradually increases the voltage at the scan electrode Y from the ΔVscH voltage to the ΔVscH+Vset voltage during the rising period of the reset period. In addition, the reset driver 420 gradually decreases the voltage at the scan electrode Y from the ΔVscH voltage to the Vnf voltage during the falling period of the reset period.

Here, a source of the transistor Yrr having a drain coupled to a power source Vset is coupled to a drain of the transistor Ynp. To interrupt a current caused by (or flowing through) the body diode of the transistor Yrr, the diode Dset is coupled in an opposite direction of the body diode of the transistor Yrr. A source of the transistor Ynp is coupled to the scan electrode Y of the panel capacitors Cp.

In addition, the transistor Yfr is coupled between a power source VscL for supplying the VscL voltage and the scan electrode Y of the panel capacitors Cp, the Vnf voltage is formed to be higher than the scan voltage VscL, and the Zener diode ZD is coupled between the transistor Yfr and the scan electrode Y. Here, it is assumed that the Vnf voltage is higher than the VscL voltage by a breakdown voltage of the Zener diode ZD. In other embodiments, the Zener diode ZD may be coupled between the power source VscL and the transistor Yfr. Since the Vnf voltage is higher than the VscL voltage, a current path may be formed through the body diode of the transistor Yfr when the transistor YscL is turned on. Accordingly, the transistor Yfr may be formed in a back-to-back manner to interrupt the current path through the body diode of the transistor Yfr.

The scan driver 430 includes selection circuits 431 and 432, a capacitor CscH, a diode DscH, and a transistor YscL. The scan voltage VscL is applied to the scan electrode Y to select the cells to be turned on during the address period, and the non-scan voltage VscH is applied to the scan electrode Y of the cells that are not turned on. The selection circuits 431 and 432 are coupled as an integrated circuit (IC) to the respective scan electrodes Y1 to Yn so as to sequentially select the plurality of scan electrodes Y1 to Yn during the address period. In addition, the driving circuits (i.e., the sustain driver 410 and the reset driver 420) other than the scan driving circuit are coupled to the scan electrodes Y1 to Yn through the selection circuits 431 and 432.

In an exemplary embodiment of the present invention, as shown in FIG. 3, it is illustrated that the selection circuit 431 is coupled to the odd group of the scan electrodes (odd line Y) and the selection circuit 432 is coupled to the even group of the scan electrodes (even line Y).

In further detail, the selection circuit 431 includes transistors Sch1 and Scl1, and the selection circuit 432 includes transistors Sch2 and Scl2. A source of the transistor Sch1 and a drain of the transistor Scl1 are coupled to the odd group of the scan electrodes (odd line Y) of the panel capacitors Cp. A source of the transistor Sch2 and a drain of the transistor Scl2 are coupled to the even group of the scan electrodes (even line Y) of the panel capacitors Cp.

Here, the transistors Sch1 and Sch2 form paths for respectively applying the non-scan voltage VscH to the odd and even groups of the scan electrodes (odd line Y and even line Y), and the transistors Scl1 and Scl2 form paths for respectively applying the scan voltage VscL to the odd and even groups of the scan electrodes (odd line Y and even line Y).

Drains of the transistors Sch1 and Sch2 are coupled to a first terminal of the capacitor CscH, and sources of the transistors Scl1 and Scl2 are coupled to a second terminal of the capacitor CscH. Here, the first terminal of the capacitor CscH is coupled to a non-scan power source VscH for applying the non-scan voltage VscH to the scan electrode Y of the cells that are not turned on, and the second terminal of the capacitor CscH is coupled to the scan power source VscL for applying the scan voltage VscL to the scan electrode Y of the turn-on cells. Here, the capacitor CscH is charged with a voltage of (VscH−VscL) when the transistor YscL is turned on, and the voltage of (VscH−VscL) corresponds to the ΔVscH voltage shown in FIG. 2.

In addition, the diode DscH is coupled between the capacitor CscH and the non-scan power source VscH. An anode of the diode DscH is coupled to the non-scan power source VscH, and a cathode thereof is coupled to the drains of the transistors Sch1 and Sch2 and the first terminal of the capacitor CscH.

In FIG. 3, while the respective transistors Ys, Yg, Yr, Yf, Yrr, YscL, Sch1, Scl1, Sch2, Scl2, and Ynp are respectively illustrated as single transistors, each of the respective transistors Ys, Yg, Yr, Yf, Yrr, YscL, Sch1, Scl1, Sch2, Scl2, and Ynp may be respectively formed by a plurality of transistors coupled in parallel.

A method for respectively applying different sustain pulses to the odd and even group scan electrodes (odd line Y and even line Y) through the selection circuits 431 and 432 to generate the second sustain discharge in the groups at different times will be described with reference to FIG. 4 and FIG. 5A to FIG. 5D.

Figure 4:
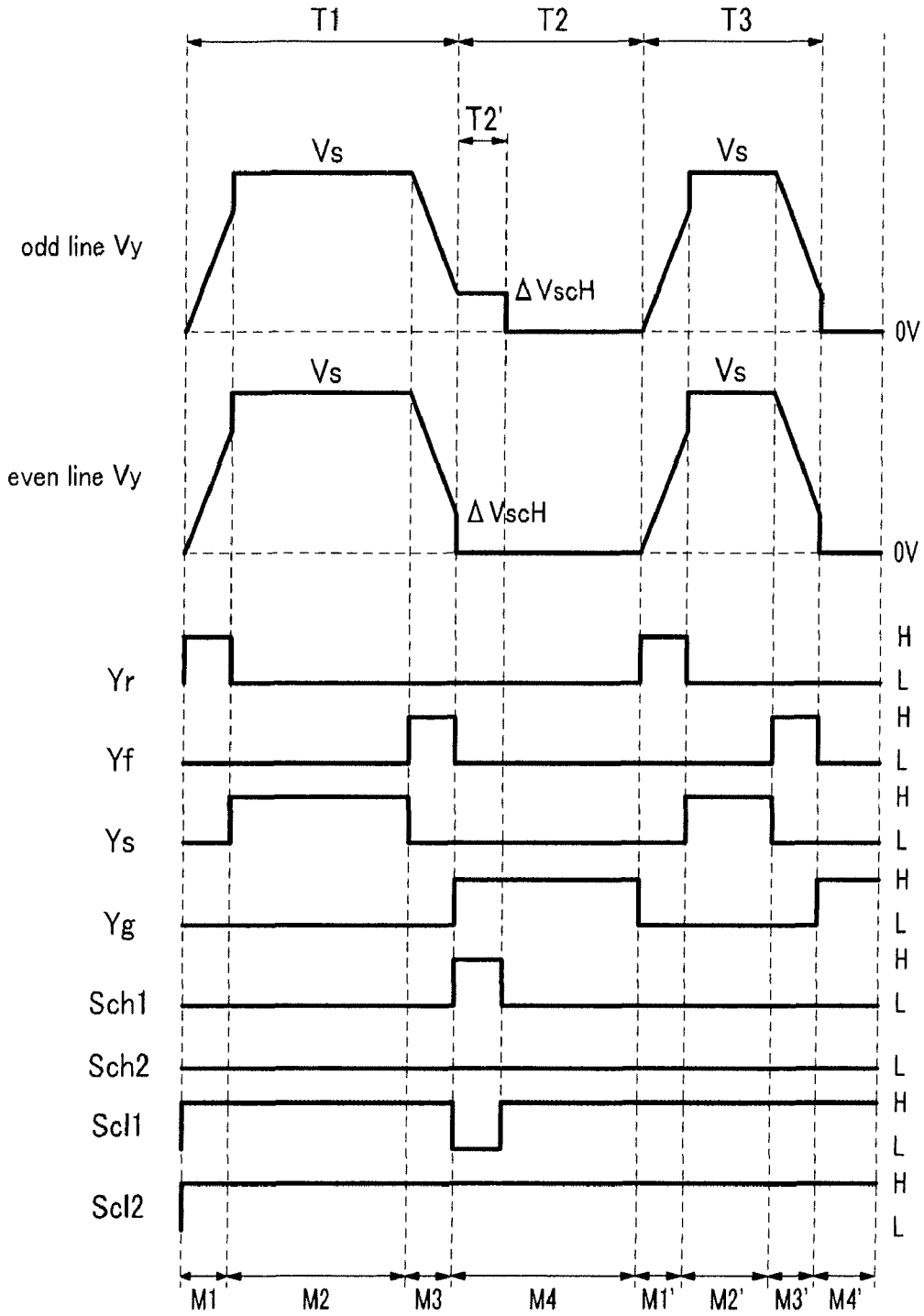
FIG. 4 shows a diagram representing driving timing of the driving circuit for generating sustain pulses according to an exemplary embodiment of the present invention.

FIG. 4 shows a diagram representing driving timing of the driving circuit for generating the sustain pulse according to an exemplary embodiment of the present invention, and FIG. 5A to FIG. 5D show diagrams representing current paths of the sustain pulse according to exemplary embodiments of the present invention.

In FIG. 4, the driving timing for generating the first sustain pulse and the second sustain pulse applied to the odd and even groups of the scan electrodes (odd line Y and even line Y) during the sustain period among the driving waveforms shown in FIG. 2 in the driving circuit shown in FIG. 3 is shown. In addition, in FIG. 4, it is assumed that the power recovery capacitor Cer has been charged with the voltage Vs/2 before a first mode M1.

Figure 5A:
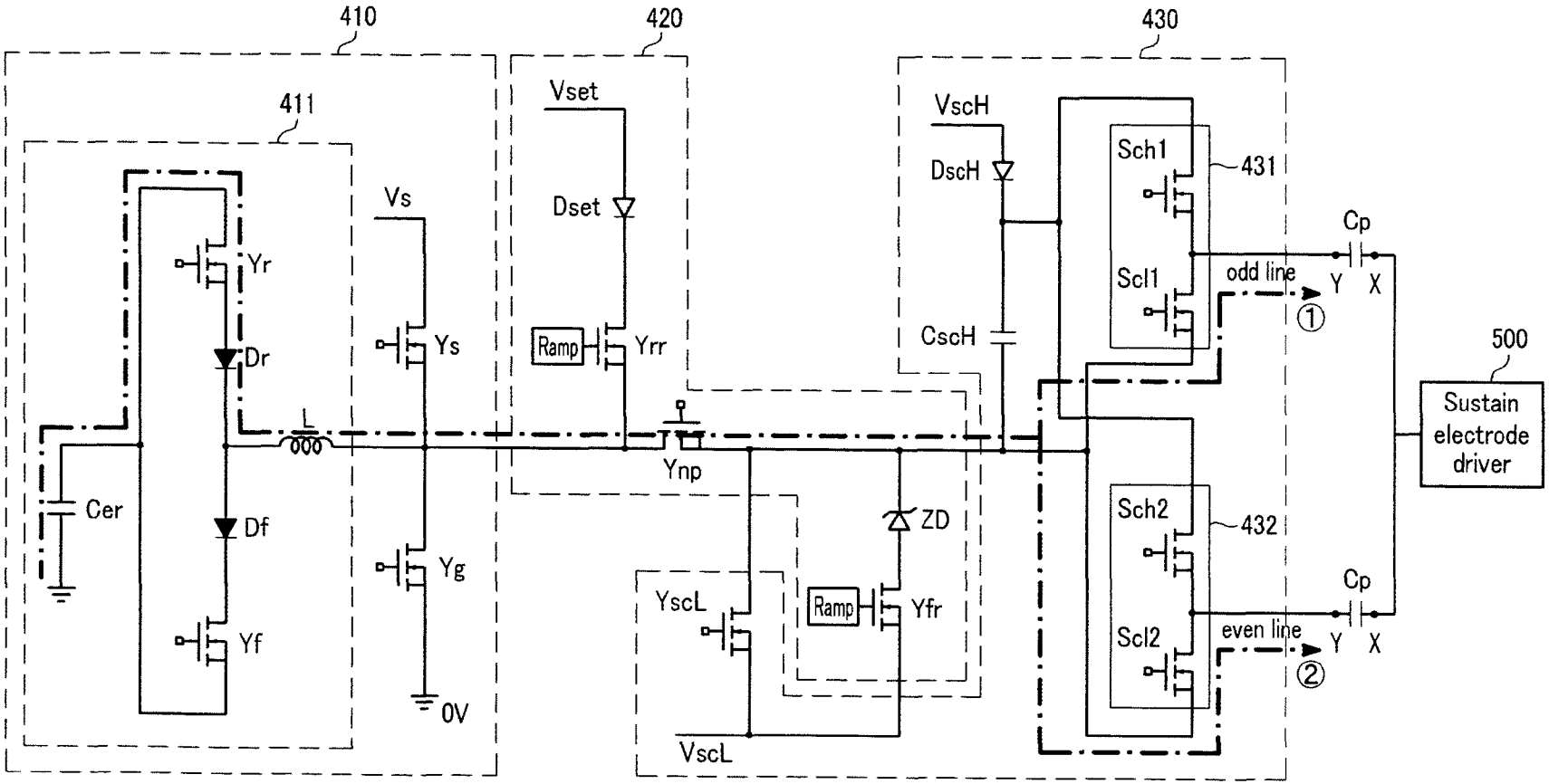
FIGS. 5A, 5B, 5C and 5D show diagrams representing current paths of the driving circuit according to an exemplary embodiment of the present invention.

The first mode M1 will be described with reference to FIG. 5A.

The transistors Yr, Ynp, Scl1, and Scl2 are turned on at the first mode M1. Thereby, as shown in FIG. 5A, a current path ① including the power recovery capacitor Cer, the transistor Yr, the diode Dr, the inductor L, the transistor Ynp, the transistor Scl1, and the odd group of the scan electrodes (odd line Y) of the panel capacitors Cp is formed, and a current path ② including the power recovery capacitor Cer, the transistor Yr, the diode Dr, the inductor L, the transistor Ynp, the transistor Scl2, and the even group of the scan electrodes (even line Y) of the panel capacitors Cp is formed, and therefore a resonance is generated between the inductor L and the panel capacitors Cp. The panel capacitors Cp are charged by the resonance, and the voltages at the odd and even groups of the scan electrodes (odd line Y and even line Y) of the panel capacitors Cp are gradually increased from the 0V voltage to a voltage near the Vs voltage.

Figure 5B:
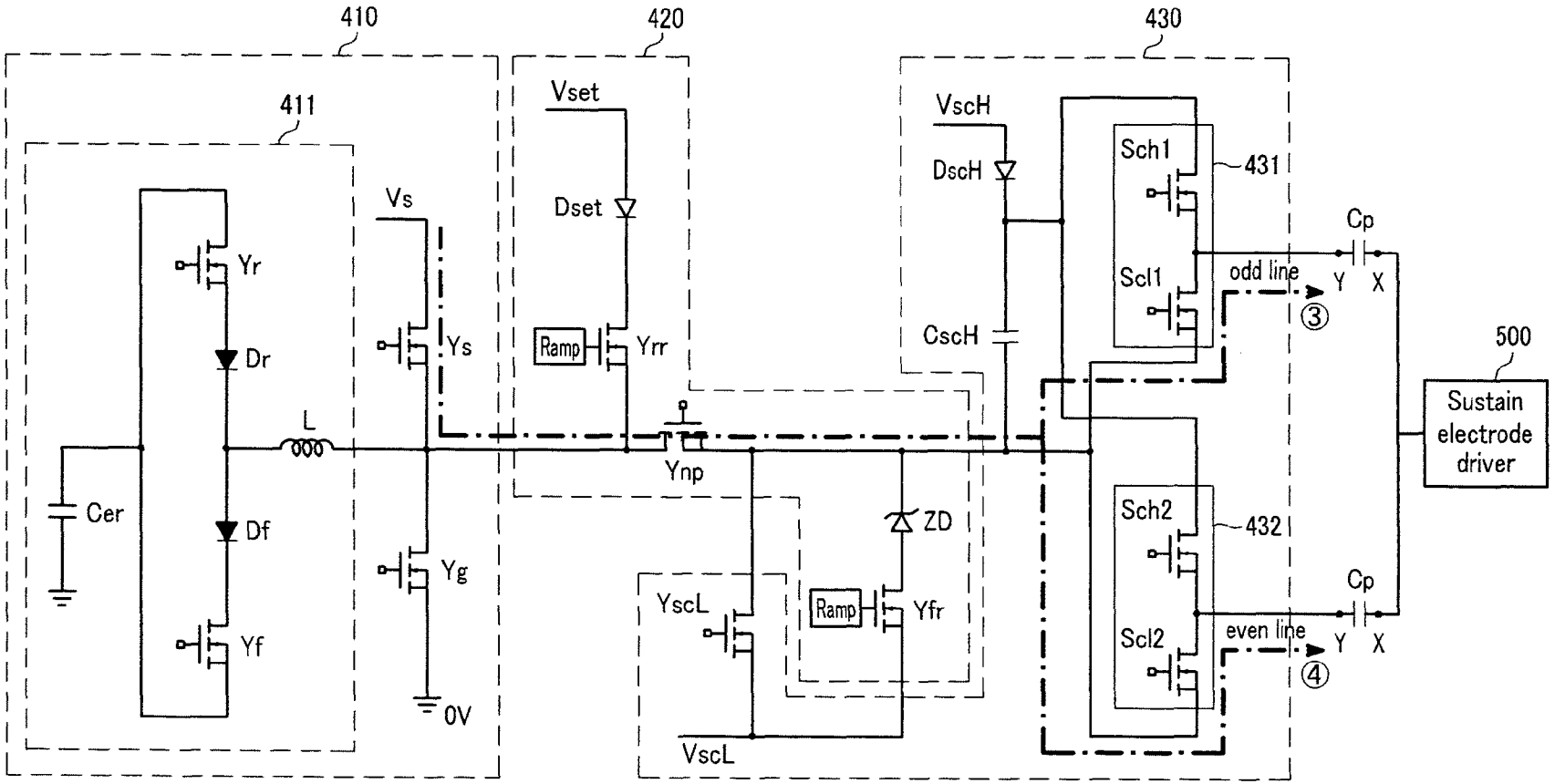

A second mode M2 will be described with reference to FIG. 5B.

The transistor Yr is turned off and the transistor Ys is turned on at the mode M2. Thereby, a current path ③ including the power source terminal Vs, the transistor Ys, the transistor Ynp, the transistor Scl1, and the odd group of the scan electrodes (odd line Y) of the panel capacitors Cp is formed, and a current path ④ including the power source terminal Vs, the transistor Ys, the transistor Ynp, the transistor Scl2, and the even group of the scan electrodes (even line Y) of the panel capacitors Cp is formed. That is, the high level voltage Vs is applied to and maintained at the scan electrodes Y.

Figure 5C:
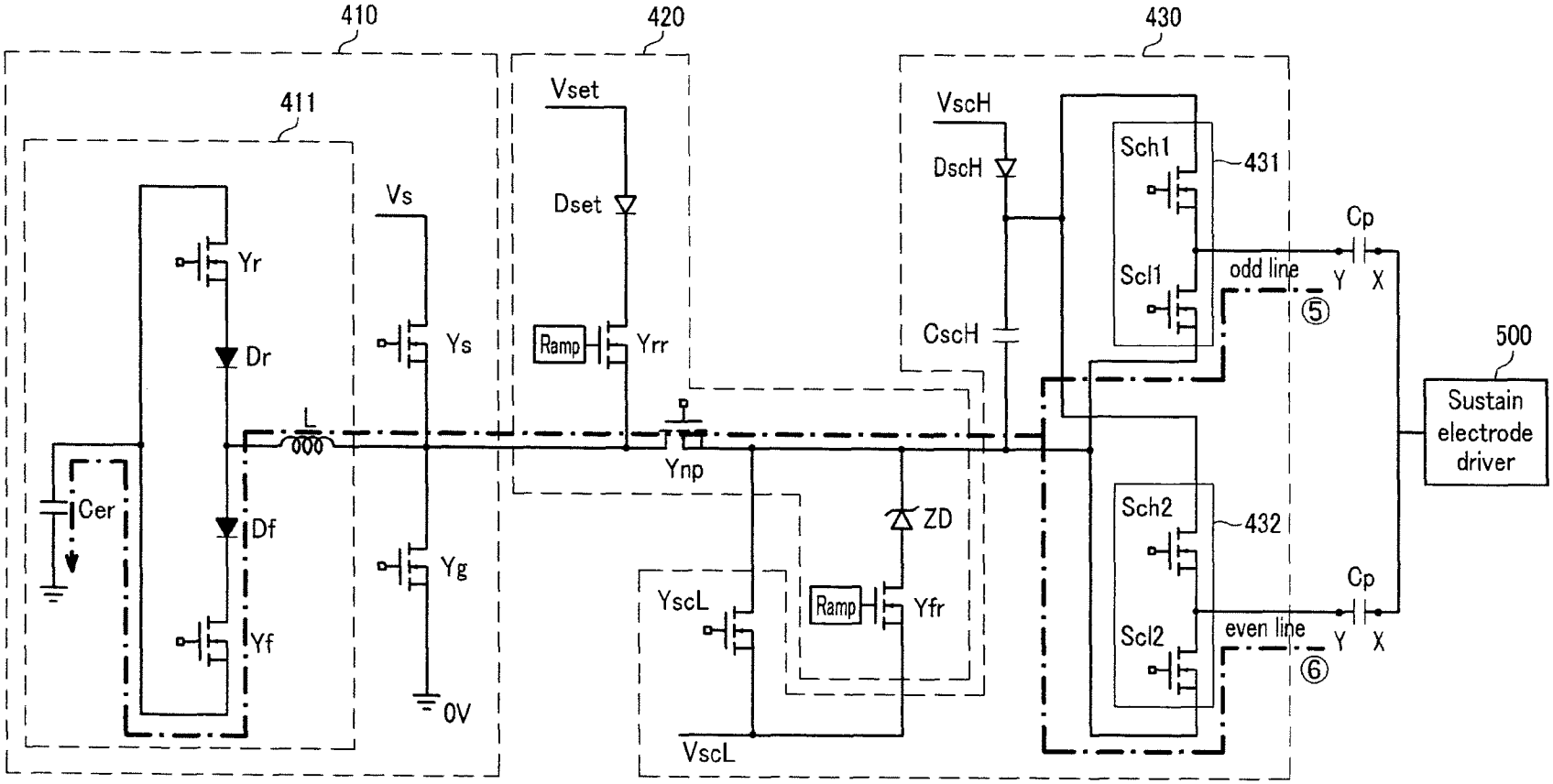

A third mode M3 will be described with reference to FIG. 5C.

The transistor Ys is turned off and the transistor Yf is turned on at the third mode M3. Thereby, as shown in FIG. 5C, a current path ⑤ including the odd group of the scan electrodes (odd line Y) of the panel capacitors Cp, the transistor Scl1, the transistor Ynp, the inductor L, the diode Df, the transistor Yf, and the power recovery capacitor Cer is formed, and a current path ⑥ including the even group of the scan electrodes (even line Y) of the panel capacitors Cp, the transistor Scl2, the transistor Ynp, the inductor L, the diode Df, the transistor Yf, and the power recovery capacitor Cer is formed, and therefore a resonance is generated between the inductor L and the panel capacitors Cp. The voltage of the scan electrodes Y of the panel capacitor Cp is gradually decreased to the low level voltage 0V by the resonance. That is, the panel capacitors Cp are discharged.

In the first mode M1 to the third mode M3, the first sustain pulse of the driving waveform shown in FIG. 2 is applied to the odd and even groups of the scan electrodes (odd line Y and even line Y) during the period T1. Here, the 0V voltage is applied to the sustain electrode X during the period T1 (see, for example, FIG. 2).

Current paths of the driving circuit formed when the second sustain pulse is applied to the odd and even groups of the scan electrodes (odd line Y and even line Y) according to an exemplary embodiment of the present invention will be described with reference to a fourth mode M4. The Vs voltage is applied to the sustain electrode X during the period of T2 (see, for example, FIG. 2). The period of T2 is relatively shorter than the period of T1.

The fourth mode M4 will be described with reference to FIG. 5D.

At the fourth mode M4, the transistor Yf is turned off and the transistor Yg is turned on during the period of T2 during which the second sustain pulse is applied to the odd and even groups of the scan electrodes (odd line Y and even line Y).

In an exemplary embodiment of the present invention, the sustain discharge is controlled to be generated in the cells formed by the odd and even groups of the scan electrodes (odd line Y and even line Y) at different times. As such, an on-off timing of the selection circuits 431 and 432 coupled to the odd and even groups of the scan electrodes (odd line Y and even line Y) is controlled.

That is, in the selection circuit 432 coupled to the even group of the scan electrodes (even line Y), the transistor Scl2 is maintained to be turned on during the period T2 similar to the third mode M3. In the selection circuit 431 coupled to the odd group of the scan electrodes (odd line Y), the transistor Sch1 is turned on and the transistor Scl1 is turned off during the portion T2' of the period T2. Subsequently, in the selection circuit 431, the transistor Sch1 is turned off and the transistor Scl1 is turned on during a remaining portion of the period T2.

Figure 5D:
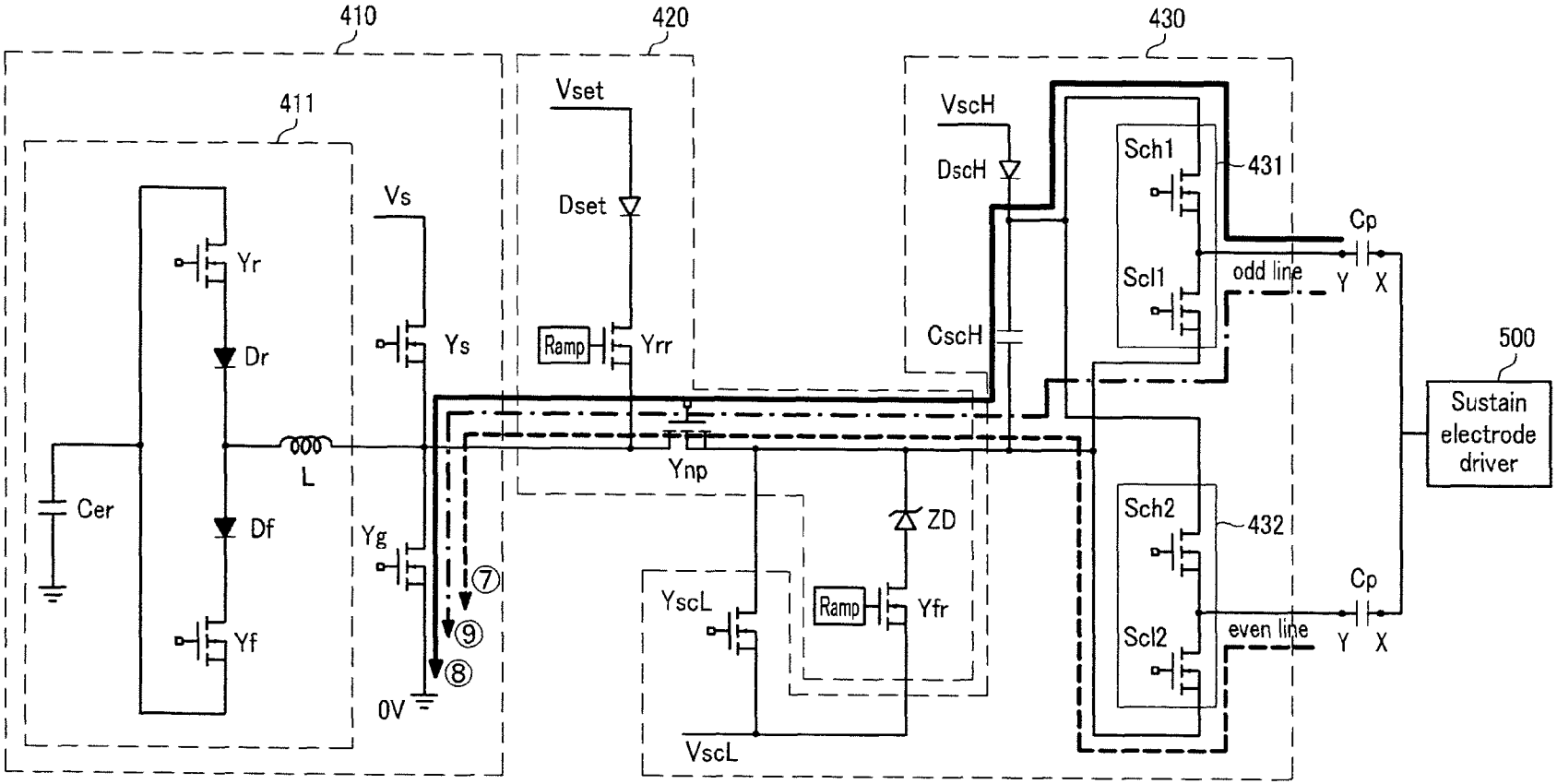

Thereby, as shown in FIG. 5D, a current path ⑦ including the even group of the scan electrodes (even line Y) of the panel capacitors Cp, the transistor Scl2, the transistor Ynp, the transistor Yg, and the ground terminal 0V is formed, and the low level voltage 0V is applied to the even group of the scan electrodes (even line Y) of the panel capacitors Cp during the period T2. In addition, a current path ⑧ including the odd group of the scan electrodes (odd line Y) of the panel capacitors Cp, the transistor Sch1, the capacitor CscH, the transistor Ynp, the transistor Yg, and the ground terminal 0V is formed, and the ΔVscH voltage charged in the capacitor CscH is applied to the odd group of the scan electrodes (odd line Y) of the panel capacitors Cp during the portion T2' of the period T2. Subsequently, during the remaining portion of the period T2, a current path ⑨ including the odd group of the scan electrodes (odd line Y) of the panel capacitors Cp, the transistor Scl1, the transistor Ynp, the transistor Yg, and the ground terminal 0V is formed, and the low level voltage 0V is applied to and maintained at the odd group of the scan electrodes (odd line Y) of the panel capacitors Cp.

Accordingly, the second sustain discharge is generated in the even group of the scan electrodes (even line Y) at an early portion (or beginning portion) of the period T2 (i.e., when the 0V voltage is applied), and the second sustain discharge is generated in the odd group of the scan electrodes (odd line Y) after the portion (i.e., when the ΔVscH voltage is no longer applied and instead the 0V voltage is applied). Therefore, the second sustain discharge is generated in the corresponding two cell groups among the cells formed by the plurality of scan electrodes at different times. That is, the discharge currents of the panel capacitors Cp may not flow to the respective elements of the driving circuit at the same time, but rather may flow at different times, and therefore the elements may not be deteriorated.

In addition, after the fourth mode M4, sustain pulses having a pulse width that is the same as that of the second sustain pulse (i.e., T2), is applied to the odd and even groups of the scan electrodes (odd line Y and even line Y) the number of times corresponding to the brightness weight value of the respective subfields. From a fifth mode M1' and up to (but not including) an eighth mode M4' shown in FIG. 4, a third sustain pulse is applied during the period T3, which is substantially equal in duration to the period T2. The fifth mode M1' to the eighth mode M4' are similar to the first mode M1 to the fourth mode M4, except that, for example, a period for applying and maintaining the Vs voltage at the odd and even groups of the scan electrodes (odd line Y and even line Y) in the sixth mode M2' is shorter than that in the second mode 2, and therefore detailed descriptions thereof will not be presented below.

In exemplary embodiments of the present invention, the switching timing of the selection circuit 431 is controlled when the second sustain pulse is applied so that the 0V voltage is applied to the odd group scan electrodes (odd line Y) after the ΔVscH voltage is applied. However, in other embodiments of the present invention, the switching timing of the selection circuit 432 may be controlled so that the 0V voltage is applied to the even group scan electrodes (even line Y) after the ΔVscH voltage is applied.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

As described above, according to exemplary embodiments of the present invention, the scan electrodes are divided into a plurality of groups, the sustain discharges for each of the groups are generated at different times, the discharge currents are dispersed, the elements of the driving circuit are prevented from being exposed to considerable amounts of discharge current, and the driving circuit may be stably driven.

What is claimed is:

1. A method for driving a plasma display device during a reset period, an address period and a sustain period, the plasma display device comprising a plurality of first electrodes including a first group of the first electrodes and a second group of the first electrodes, and a plurality of second electrodes, the method comprising:

during a first period of the sustain period, applying a second voltage to the first group of the first electrodes and the second group of the first electrodes while a first voltage is applied to the second electrodes, the second voltage being higher than the first voltage; and during a second period of the sustain period, while the second voltage is applied to the second electrodes, applying the first voltage to the first group of the first electrodes, and applying the first voltage to the second group of the first electrodes a period of time after when the first voltage is initially applied to the first group of the first electrodes in the second period, wherein the first period is longer than the second period, and a third voltage between the first voltage and the second voltage is applied to the second group of the first electrodes during the period of time.

2. The method of claim 1, wherein the third voltage is higher than the first voltage by a voltage difference between a scan voltage and a non-scan voltage applied to the first electrodes during the address period.

3. The method of claim 2, wherein the first voltage is a low level voltage of a sustain pulse applied to the first electrodes and the second electrodes during the sustain period, and the second voltage is a high level voltage of the sustain pulse.

4. The method of claim 3, wherein the first period is an initial period of the sustain period.

5. The method of claim 4, wherein the second period is subsequent to the first period.

6. The method of claim 5, further comprising:

alternately applying the first voltage and the second voltage to the first electrodes and the second electrodes during a third period of the sustain period, the third period following the first period and the second period.

7. A plasma display device adapted to be driven during a reset period, an address period and a sustain period, the plasma display device comprising:

a plasma display panel comprising:

a plurality of first electrodes including a first group of the first electrodes and a second group of the first electrodes; and a plurality of second electrodes, wherein a plurality of panel capacitors are formed by the first and second electrodes;

a scan driver comprising a plurality of selection circuits, a first selection circuit of the selection circuits including first and second switches and a second selection circuit of the selection circuits including third and fourth switches, the scan driver being for sequentially applying a scan voltage to the first group of the first electrodes through the first switch and to a second group of the first electrodes through the third switch, and applying a non-scan voltage to the first group of the first electrodes through the second switch and to the second group of the first electrodes through the fourth switch; and a sustain driver for applying a sustain pulse alternately having a first voltage and a second voltage lower than the first voltage to the first group of the first electrodes through the first selection circuit, and applying the sustain pulse to the second group of the first electrodes through the second selection circuit, wherein, during the sustain period, the sustain driver is configured to:

during a first period of the sustain period, apply the first voltage to the first group of the first electrodes and the second group of the first electrodes through the first and third switches, respectively;

during a second period of the sustain period, apply the second voltage to the second group of the first electrodes through the third switch, the second period being shorter than the first period;

during a period of time starting when the second voltage is initially applied to the second group of the first electrodes in the second period, apply a third voltage between the first and second voltages to the first group of the first electrodes through the second switch; and after the period of time in the second period, apply the second voltage to the first group of the first electrodes through the first switch.

8. The plasma display device of claim 7, wherein the scan driver further comprises a capacitor having a first terminal electrically coupled to a non-scan power source for supplying the non-scan voltage and a second terminal electrically coupled to a scan power source for supplying the scan voltage, wherein the capacitor is configured to be charged with a voltage corresponding to a voltage difference between the scan voltage and the non-scan voltage.

9. The plasma display device of claim 8, wherein the capacitor is further configured to be charged with the third voltage.

10. The plasma display device of claim 9, wherein the sustain driver comprises:

a fifth switch electrically coupled between the plurality of first electrodes and a first power source for supplying the first voltage, to form a path for applying the first voltage to the plurality of first electrodes;

a sixth switch electrically coupled between the plurality of first electrodes and a second power source for supplying the second voltage, to form a path for applying the second voltage to the plurality of first electrodes;

an inductor having a first terminal electrically coupled to the plurality of first electrodes and a second terminal electrically coupled to a power source for supplying a fourth voltage, the fourth voltage being between the first and second voltages;

a seventh switch for forming a path for increasing a voltage at the plurality of first electrodes towards the first voltage through the inductor; and an eighth switch for forming a path for decreasing the voltage at the plurality of first electrodes towards the second voltage through the inductor.

11. The plasma display device of claim 10, wherein the first switch is electrically coupled between the first group of the first electrodes and each of the fifth and sixth switches to form a path for applying the sustain pulse to the first group of the first electrodes, wherein the third switch is electrically coupled between the second group of the first electrodes and each of the fifth and sixth switches to form a path for applying the sustain pulse to the second group of the first electrodes, and wherein the second switch is electrically coupled between the first terminal of the capacitor and the first group of the first electrodes to form a path for applying the third voltage to the first group of the first electrodes.

12. The plasma display device of claim 11, wherein, in the sustain period:

during a first sub-period of the first period, the seventh switch, the first switch, and the third switch are turned on, and a resonance between the inductor and the plurality of the first electrodes is generated to increase the voltage at the plurality of the first electrodes towards the first voltage;

during a second sub-period of the first period, the seventh switch is turned off, the fifth switch is turned on, and the first voltage is applied to the plurality of first electrodes;

during a third sub-period of the first period, the fifth switch is turned off, the eighth switch is turned on, and the resonance between the inductor and the plurality of first electrodes is generated to decrease the voltage at the plurality of first electrodes towards the second voltage;

during the second period, the eighth switch is turned off, the sixth switch and the third switch are turned on, and the second voltage is applied to the second group of the first electrodes;

during the period of time in the second period, the first switch is turned off, the second switch is turned on, and the third voltage is applied to the first group of the first electrodes; and following the period of time in the second period, the second switch is turned off, the first switch is turned on, and the second voltage is applied to the first group of the first electrodes.

13. The plasma display device of claim 12, wherein the first voltage is applied to the plurality of second electrodes during at least the second period, and a duration of the application of the first voltage to the plurality of second electrodes is shorter than the second sub-period of the first period.

14. The plasma display device of claim 7, further comprising a reset driver coupled between the scan driver and sustain driver, the reset driver being for applying a reset voltage to the first electrodes during the reset period.

15. The plasma display device of claim 14, wherein the reset driver comprises a fifth switch.

16. The plasma display device of claim 14, wherein the reset voltage, at at least one portion of the reset period, has a value substantially equal to that of the third voltage.

17. The plasma display device of claim 7, wherein, in the address period, the scan driver is adapted to apply the scan voltage to the first group of the first electrodes before applying the scan voltage to the second group of the first electrodes.

* * * * *